United States Patent [19]

Hafke et al.

[11] 4,187,080

[45] Feb. 5, 1980

[54] TREATING CONDENSATE FROM GASIFICATION OF COAL

[75] Inventors: Carl Hafke, Frankfurt am Main; Roland Weber, Bruchköbel; Rudolf Kohlen, Wehrheim, all of Fed. Rep. of Germany

[73] Assignee: Metallgesellschaft Aktiengesellschaft, Frankfurt, Fed. Rep. of Germany

[21] Appl. No.: 840,433

[22] Filed: Oct. 7, 1977

Related U.S. Application Data

[63] Continuation of Ser. No. 704,253, Jul. 12, 1976, abandoned.

[30] Foreign Application Priority Data

Feb. 26, 1976 [DE] Fed. Rep. of Germany ..... 2607745

[51] Int. Cl.[2] ..... C10J 3/16

[52] U.S. Cl. ..... 48/202; 48/206; 55/228; 252/373

[58] Field of Search ..... 48/197 R, 202, 203, 48/206, 210; 201/29, 30; 55/228, 421; 252/373

[56] References Cited

U.S. PATENT DOCUMENTS

| | | | |
|---|---|---|---|
| 2,142,406 | 1/1939 | Nonrebel et al. | 55/228 |
| 2,657,124 | 10/1953 | Gaucher | 48/202 |
| 2,799,565 | 7/1957 | Just | 48/210 |
| 3,396,514 | 8/1968 | Hurst et al. | 55/228 |
| 3,540,867 | 11/1970 | Baron et al. | 48/206 |
| 3,607,157 | 9/1971 | Schlinger et al. | 48/206 |

*Primary Examiner*—S. Leon Bashore
*Assistant Examiner*—Peter F. Kratz
*Attorney, Agent, or Firm*—Sprung, Felfe, Horn, Lynch & Kramer

[57] ABSTRACT

In the production of gas from a solid fuel comprising effecting gasification by contacting the solid fuel with oxygen and water under pressure to form raw gas containing tar, solids and water, cooling the raw gas to effect condensation of the tar and water, the condensate containing the solids, separating from the solids-containing condensate a fraction enriched in solids, and disposing of said fraction, the improvement which comprises effecting said disposition by feeding at least part of said fraction to a solids disintegrator wherein the solids are reduced in size, and recycling at least part of the condensate containing disintegrated solids to the gasification step. Disintegration serves to reduce substantially all the particles to below about 2 mm with the predominant part below about 0.5 mm. Part of the condensate may also be recycled to the separation stage and all the recycled condensate is kept above 50° C. to prevent solidification of tars. The process permits continuous operation of a gasification plant without clogging of pipes and pumps such as otherwise necessitate equipment shutdown for cleaning.

4 Claims, 1 Drawing Figure

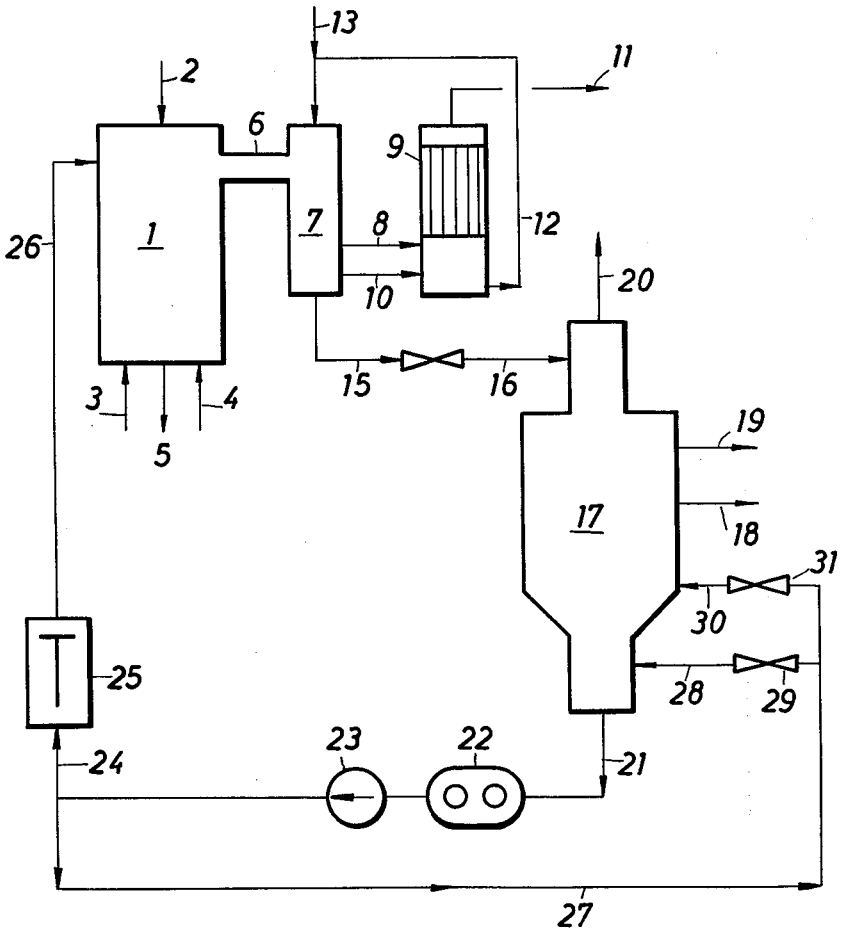
13
2
11
6
9
1
7
8
12
26
10
20
15
16
3
4
5
19
17
18
31
30
25
28
29
23
22
24
21
27

TREATING CONDENSATE FROM GASIFICATION OF COAL

This is a continuation of application Ser. No. 704,253, filed July 12, 1976, now abandoned.

BACKGROUND

This invention relates to a process of treating condensate formed by a cooling of raw gas produced from solid fuels by a pressure gasification comprising a treatment with oxygen and water vapor. Carbon dioxide may be used as a further gasifying agent.

The solid fuels which are suitable for pressure gasification include mainly coal, brown coal, and peat. It is basically known to gasify such solid fuels under operating pressures in the range of about 5–150 bars, preferably about 10–80 bars. The pressure gasification can be carried out with particularly good results in the Lurgi gas-producing reactor, details of which are described in Printed German Application No. 1,021,116, German Patent No. 2,352,900, and U.S. Pat. Nos. 3,540,867; 3,902,872; and 3,930,811, the disclosure of which are incorporated herein by reference.

The known pressure gasification process results in a raw gas, which leaves the pressure reactor at temperatures in the range of about 400°–700° C. and which contains on a dry basis about 20–80% water vapor and about 1–10 g finegrained solids per standard cubic meter. Tests have shown that the particle size range of the solids entrained by the raw gas depends highly on the space velocity in the reactor. It has been found that the gasification of caking coals and particularly also of swelling coal results in a discharge of more solids than the gasification of non-caking and non-swelling coals. The solids consist mainly of unreacted fuel and of ash particles.

The raw gas discharged from the pressure reactor is first scrubbed in direct contact with water and cooled condensate. This scrubbing results in a removal of solids and in a condensation of part of the hydrocarbons, tars and water vapor. When the gasification results in a raw gas having a high solids content, pumpable condensates may no longer be formed after a short time of operation. It is also known that the processing of caking and swelling coals can be much improved in that the mixture which is obtained after the cooling of the raw gas and which contains tars, hydrocarbons, and solids, is recycled at least in part to the pressure gasification process.

At the present state of the art relating to the pressure gasification of solid fuels, the pressure gasification reactors can be operated at a high throughput rate of about 10–20 metric tons of fuel per hour. This results in an increase of the absolute quantities of solids entrained by the raw gas and also in a larger average particle diameter of said solids. After a certain time of operation these phenomena may result in disturbances in the conduit and pump system. Experiments in which screens were used to separate the coarse-grained solids from the condensate mixture have not given satisfactory results because these coarse separators must be cleaned at a considerable expenditure. The coarse particles which are thus removed still contain high boiling tars and must be destroyed at a considerable expenditure because discarding of such solids is not permissible for ecological reasons.

For this reason it is an object of the invention so to improve a process of the kind defined first hereinbefore that the disadvantages involved in previous proposals are avoided and a trouble-free and economical operation is ensured. This is accomplished according to the invention in that the condensate, which contains tar, solids, and water, is fed to a separator, a heavy fraction having a high solid content is withdrawn from said separator, at least part of said heavy fraction is processed in a solids disintegrator, part of the processed solids having a particle size substantially below about 2 mm are added to the condensate derived from the raw gas produced by pressure gasification, and another part of the processed solids is recycled to the separator.

After the processing in the solids disintegrator, the high-solids fraction derived from the condensate mixture no longer contains any substantial quantity of coarse particles having a size above 2 mm. The processing in the solids disintegrator results also in a mixing of the particles in the condensate to a certain degree and in a homogenization of the mixture. It has been found that the processed mixture no longer tends to form disturbing deposits, particularly in conduits and pumps.

The condensate which is recycled to the pressure gasification process and the condensate which is fed to the separator are suitably kept at a temperature above about 50° C., preferably above about 70° C. The increased temperature prevents solidification of the tar constituents in the condensate. Such solidified tar constituents could promote adhesion of deposits and clogging. The high-solids heavy fraction withdrawn from the separator may have a solids content of about 10–60%. This mixed fraction can be handled without trouble even when its solids content is close to or at said upper limit.

The processing of the condensate in the solids disintegrator is suitably controlled so that a predominant part of the solids in the processed condensate has a particle size below about 0.5 mm. Solids having a small particle size can be more easily maintained in a state of fine division in the tar-containing condensate so that they will not give rise to any trouble.

An embodiment of the process according to the invention will be explained with reference to the drawing which is a schematic flow sheet.

Granular solid fuel, particularly coal, is fed to a pressure gasification reactor 1 through a conduit 2. The reactor 1 is fed with oxygen-containing gas through conduit 3 and with water vapor through conduit 4. The ash left after the gasification is withdrawn in conduit 5. During the pressure gasification in the reactor 1, the fuel is held in a packed bed and moves opposite to the direction of flow of the gasifying agents oxygen and water vapor. The raw gas produced by the gasification flows at temperatures of about 400°–700° C. from the reactor 1 into a scrubber-cooler 7 and is directly contacted therein with a mixture of water and condensate at temperatures of about 160°–220° C. Scrubbed gas which is saturated with water vapor is conducted in conduit 8 to a waste-heat boiler 9. Through conduit 10, part of the condensate collected in the scrubber-cooler 7 is added to the water-heat boiler. The gas which has been cooled in the waste-heat boiler leaves the latter through conduit 11. Condensate collected in the sump of the waste-heat boiler is returned through conduit 12 to the scrubber-cooler 7. Fresh water is added through conduit 13. In some embodiments, the gas having a saturation temperature of 160°–180° C. must be purified further and used, e.g., in a combined gas-steam turbine process. In such case, the waste-heat boiler may be eliminated and the saturated gas leaving the scrubber-cooler is fed to any purification stages which may be required.

A condensate mixture which contains the solids that have been removed from the raw gas in the scrubber-cooler 7 is discharged in conduit 15 and is pressure-relieved in atmospheric pressure in one or more pressure-relief stages. The pressure-relieved mixture is fed to a separator 17, in which the several constitutents of the mixture are separated by gravity. A major portion of the solids mainly together with heavy, high-boiling tar, is collected in the lowermost part of the separator 17. Hydrocarbons, lower-boiling tars and oil are enriched in an intermediate portion above said solids; these constituents contain only little dust and are fed through conduit 18 to means for their further processing. The upper part of the gravity separator 17 contains a mixture which comprises aqueous condensate, light hydrocarbons and light oils. This mixture is withdrawn through withdrawal conduit 19. Pressure-relieved gas leaves the separator through conduit 20.

The high-solids heavy fraction separated in the separator 17 is fed from the lower end of the separator through conduit 21 to a disintegrator 22. The solids are embedded in a vehicle of high viscosity and are disintegrated in the disintegrator 22 to a final particle size upper limit of about 2 mm. The disintegration of the solids results also in a homogenization of the mixture as it passes through the disintegrator. Suitable disintegrators are, e.g., dispersing machines known for the production of pharmaceuticals (Ullmann's Encyklopädie der technischen Chemie, Vol. 4 (1953), pages 21/22). At least part of the solids-containing condensate discharged from the disintegrator 22 is fed by pump 23 through conduit 24 and by a metering pump 25 through conduit 26 and is thus recycled into the upper portion of the pressure gasification reactor 1. The surplus of the condensate mixture is recycled through conduit 27 to the separator 17 and is fed thereto either through a conduit 28, which includes a valve 29, or through a conduit 30, which includes a valve 31. In case the feed of recycled tar-dust mixture via pump 25 and conduit 26 has to be reduced or even stopped, still a certain amount of flow in the system has to be maintained to avoid separation of solids in the mixture. For this purpose conduit 27 is foreseen in which the flow can be adjusted by valve 29 or 31. If the flow in conduit 26 is completely stopped, the amount of flow in conduit 27 should be about 20–60% of the amount of mixture normally withdrawn from separator 17 by conduit 21. Under normal operation conditions the flow rate in conduit 27 should be at least 10% of the normal feed rate in conduit 26 and may be increased in order to adjust the ratio of dust and tar in the mixture withdrawn from separator 17 by conduit 21. Though feeding part of the mixture back to separator 17 via conduit 27 may be advantageous, it is not an essential feature of the process.

The invention is further described in the following illustrative example.

EXAMPLE 1

A Lurgi gas-producing reactor 1 operated at an output rate of 2000 standard $m^3/h$ moist raw gas per $m^2$ of the inside cross-sectional area of the reactor was fed with coal having the following specification:

| | |
|---|---|
| Tar content (Fischer analysis) | 12% by weight |

-continued

| | |
|---|---|
| Caking index (according to Damm) | 12 |
| Particle size range of coal | 3–30 mm |
| Swelling index | 4 |

The pressure gasification reactor is operated under a pressure of 20 bars and discharges a raw gas which is at a temperature of 550° C. The raw gas is cooled to 180° C. in the scrubber-cooler. A tar- and dust-containing condensate mixture is fed to a gravity separator 17, from the lower end of which a high-solids heavy fraction is withdrawn. The solids have an average particle diameter of about 1.5 mm and the mixture has a solids content of 20% by weight. The commercially available pumps used to recycle the mixture to the pressure reactor 1 and to recycle the mixture through corduit 27 failed after about 10 hours of operation so that the gasification then had to be stopped. When screens were installed in conduit 21, gas could be produced for a longer time but a tar- solids mixture had to be removed from the plant and destroyed at a rate of 100 liters per hour and per pressure reactor.

EXAMPLE 2

The same gas producer as in Example 1 was operated at an output rate of 5000 standard $m^3/h$ raw gas per $m^2$ of the inside cross-sectional area of the reactor, i.e., at 2½ times the output rate in Example 1. The feed coal and the significant operating conditions were the same as in Example 1.

The higher output rate had the result that the average particle diameter of the solids contained in the raw gas increased to 5 mm. Because the process was carried out as shown in the drawing and included the use of the solids disintegrator 22, the solids in the mixture conducted in conduit 21 were disintegrated substantially to a particle size upper limit of 2 mm. The average particle diameter was about 0.5 mm and the condensate mixture had a solids content of 45% by weight. Although solids-containing condensate was not removed from the plant, the gasification could be effected continuously for several months.

It will be appreciated that the instant specification and examples are set forth by way of illustration and not limitation, and that various modifications and changes may be made without departing from the spirit and scope of the present invention.

What is claimed is:

1. The process for the production of gas from coal which comprises the steps of:

(a) effecting gasification by contacting a packed bed of coal with oxygen and water vapor at a pressure in the range of about 5–150 bars to form a raw gas containing tar, solids and water at a temperature of about 400°–700° C.;

(b) cooling said raw gas to effect condensation of the tar and water by contacting it with a cooling liquid containing water at a temperature of about 160°–220° C., the condensate containing the solids;

(c) separating from the solids-containing condensate a heavy fraction enriched in high-boiling tar with a solids content of about 10–60%;

(d) passing said heavy fraction to a solids disintegrator wherein substantially all of the solids are reduced in size to a particle size substantially below about 2 mm;

(e) then recycling at least part of said heavy fraction from step (d) to the gasification step (a); and (f) finally recycling the balance of said heavy fraction to the separation step of step (c).

2. A process according to claim 1, wherein the condensate which is recycled to the gasification stage is kept at a temperature above about 50° C.

3. A process according to claim 1, wherein the disintegration reduces the predominant part of the solids to a particle size below about 0.5 mm.

4. A process according to claim 1, wherein the disintegration reduces the predominant part of the solids to a particle size below about 0.5 mm, and the condensate recycled to the gasification stage and to the solids-enriched fraction separation is kept at a temperature above about 70° C.

* * * * *